United States Patent [19]

Norton et al.

[11] Patent Number: 4,876,053

[45] Date of Patent: Oct. 24, 1989

[54] PROCESS OF MOLDING A COMPONENT OF A SOLE UNIT FOR FOOTWEAR

[75] Inventors: Edward J. Norton, Boxford; Craig F. Fram, Haverhill; Kenneth W. Graham, Wakefield, all of Mass.; James A. Smith, St. Louis Park, Minn.

[73] Assignee: New Balance Athletic Shoe, Inc., Boston, Mass.

[21] Appl. No.: 224,247

[22] Filed: Jul. 26, 1988

Related U.S. Application Data

[60] Continuation of Ser. No. 897,903, Aug. 19, 1988, abandoned, which is a division of Ser. No. 848,197, Apr. 4, 1986, Pat. No. 4,730,402.

[51] Int. Cl.[4] ..... A43B 10/00

[52] U.S. Cl. ..... 264/255; 264/278; 264/328.8; 264/331.15; 264/331.19; 12/142 P; 12/146 BR

[58] Field of Search ..... 264/255, 275, 277, 278, 264/328.8, 331.15, 331.19; 12/142 E, 142 P, 146 BR; 36/32 R, DIG. 2

[56] References Cited

U.S. PATENT DOCUMENTS

| | | | |
|---|---|---|---|
| 2,563,438 | 8/1951 | Weidner | 36/19.5 |
| 3,663,679 | 5/1972 | Bane et al. | 264/255 |
| 4,302,892 | 12/1981 | Adamik | 36/31 |
| 4,316,335 | 2/1982 | Giese et al. | 36/28 |
| 4,364,188 | 12/1982 | Turner et al. | 36/31 |
| 4,364,189 | 12/1982 | Bates | 36/31 |
| 4,551,930 | 11/1985 | Graham et al. | 36/30 R |

*Primary Examiner*—Hubert C. Lorin
*Attorney, Agent, or Firm*—Pennie & Edmonds

[57] ABSTRACT

The process of molding a component of a sole unit for an athletic shoe comprising the steps of supporting a core of a first plastic material in a cavity of a mold, the core defining an integral part of the component and extending within a heel region toward a forefoot region, supporting at least one rigid plug member within the cavity juxtaposed and in partially surrounding relation to the core, injecting a second plastic material into the cavity to fill the cavity, to form a shell around the core, at least partially curing the injected plastic material, removing the plug member, and injecting a third plastic material which upon curing forms a second resilient plastic material having a hardness (Shore A) greater than that of the material of the core into the cavity to fill the area heretofore occupied by the plug member, the plug member being shaped such that the third plastic material forms a set of posts.

5 Claims, 4 Drawing Sheets

PROCESS OF MOLDING A COMPONENT OF A SOLE UNIT FOR FOOTWEAR

This is continuation of application Ser. No. 897,903 filed Aug. 19, 1988, now abandoned, which is a division of application Ser. No. 848,197filed Apr 4, 1986, now U.S. Pat. No. 4,730,402.

DESCRIPTION

1. Technical Field

The invention is in a sole unit for footwear, and particularly a midsole/wedge component formed of plastic material. The midsole/wedge component includes a channel or core within a central, portion extending from longitudinally from the rear of the heel forwardly and a pair of posts bounding the channel along the medial and lateral sides. The hardness (Shore A) of the material of the respective posts, may vary in relation to one another, but in any event may be the same or it is greater than that of the material of the channel to minimize excessive rear foot motion and instability.

2. Background of the Invention

Over the years there have been many attempts to construct a sole unit for an athletic shoe to meet varying requirements of feel, function and support as well as to construct a sole unit of varying materials. To this end, for example, there have been attempts to provide a sole unit with better memory characteristics and an increased capability of dispersion of shock during running, as well as to meet other demands of various running groups. U.S. Pat. Nos. 2,563,438 (Weidner), 4,302,892 (Adamik), 4,316,335 (Giese et al), 4,364,188 (Turner et al), 4,364,189 (Bates) and 4,506,462 representative in their disclosures of these prior art attempts.

Turning to the prior art, the Weidner patent discloses a construction of sole including an outsole formed preferably of leather and a strip which circumscribes the outsole. The strip is formed of rubber or similar material The outsole may be bonded to the outer surface of an insole, and the strip may be bonded around the outsole to the marginal edge of the upper. It is indicated by the patentee that the strip which lies in the plane of the outsole assists in the provision of a cushioned walk.

The Adamik patent discloses an intermediate sole which has some similarity to the outsole and strip disclosed by Weidner. The intermediate sole includes a core and an outer portion located along the entire outer periphery of the intermediate sole. The core and the outer portion along the outer periphery are both fabricated from a closed cell foam, and the hardness of the closed cell foam forming the core is less than the hardness of the closed cell foam forming the outer portion.

The Giese et al patent discloses a construction of intermediate sole that generally follows the construction of both Weidner and Adamik. To this end, the intermediate sole includes an outer portion and a core portion Again, the outer portion is an outer peripheral portion.

The Turner et al patent discloses a running shoe of a construction similar to the construction of the athletic shoe described by Giese et al. According to Turner et al, the midsole includes a pair of resilient inserts, one within a recess in the area of the heel and the other within a recess in the area of the forefoot of the sole. The inserts may be formed of a foamed, closed cell material having a hardness substantially lower than the hardness of the midsole to provide a cushioning effect.

In addition, Turner et al disclose that a plurality of plugs formed of hard rubber and having a hardness greater than the hardness of the midsole may be located in a region toward the medial side of the midsole, between the edge and the heel insert. The plugs provide heel stabilization by increasing resistance to compression at the medial side of the heel portion of the midsole. Turner et al disclose further forms of heel stabilization provided by triangular prism shaped portions, and by a mass of resilient material secured within a notch. The notch and prism shaped portions are located along the medial side of the heel.

The Bates patent discloses a running shoe having differential cushioning characteristics To this end, Bates discloses a midsole having different measures of firmness along the medial and lateral sides According to Bates, the material along the medial side of the midsole has a firmness approximately twice that of the firmness of the material along the lateral side of the midsole.

The Cavanagh patent discloses a midsole and a heel sole layer which supports the midsole The heel sole layer, further, is formed by two portions which extend longitudinally along the medial and lateral sides, respectively, of the heel sole layer The portion along the lateral side of the heel sole layer may be formed of a synthetic foam material and the extending portion along the medial side of the heel sole layer may be formed of a material harder than the material along the lateral side.

The Graham et al patent discloses various components of a sole including an integral midsole/wedge, a midsole and a wedge which include a core of a first plastic material and a shell of a second plastic material substantially encapsulating the core The different plastic materials impart different characteristics to the sole components.

While the athletic shoes which previously have been described may provide many desired and sought-after results, the sole unit, and particularly the midsole/-wedge component of the sole unit adapted for use with footwear, such as an athletic shoe is considered to be an improvement over the known prior art.

SUMMARY OF THE INVENTION

The invention envisions a product in the form of a midsole/wedge component for a sole unit of footwear, such as an athletic shoe. The midsole/wedge component includes a core extending within the heel region toward the forefoot region and a pair of posts, also extending within the heel region toward the forefoot region, located along the medial and lateral sides of the core. The core and posts are formed of plastic material, and the hardness of the material of the core is less than the hardness of the material of either post The posts, throughout their length from the rear of the heel, are located juxtaposed to the core and their internal surface at least partially describes the interior outline of the core which may be characterized as a channel.

The invention envisions several modifications wherein the posts are arranged in either a symmetrical or asymmetrical pattern. These terms will be defined as the description continues. Further, the invention envisions a pair of posts that may be either symmetrical or asymmetrical and which have the same hardness (Shore A), or a pair of posts one of which may have a hardness different from that of the other post. In all cases both posts have a hardness (Shore A) greater than that of the core.

The invention also envisions several processes of forming a midsole/wedge component. According to one process, a fabrication process, the parts of the midsole/wedge component including the posts and core are die cut from stock material, routed to proper angles and bonded or adhesively secured together. According to another process, the fabricated midsole/wedge component may be compression molded in a molding cavity. As will be described the further step of compression molding a theretofore fabricated midsole/wedge component may result in a midsole/wedge component having a value of compression set about one-quarter the value of compression set of that of the fabricated midsole/wedge component. A third process considers the formation by molding of the midsole/wedge component. The molded midsole/wedge component will have substantially no compression set.

The invention will be more particularly described and the advantages of the invention will become more apparent as the description, to be read in conjunction with a view of the drawing, continues.

BEST MODE FOR CARRYING OUT THE INVENTION

Figure 1:
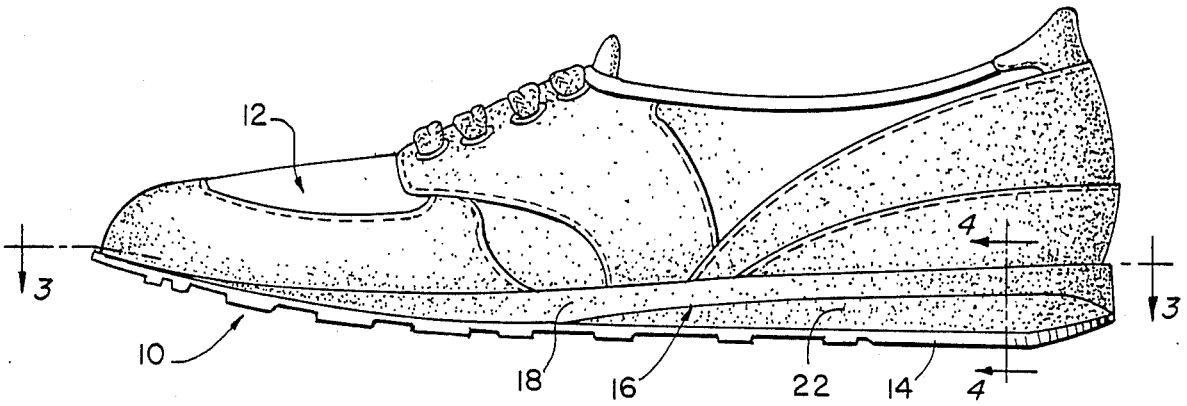
FIG. 1 is a side elevational view of an athletic shoe (the left shoe) illustrating a midsole/wedge component of the invention.
Figure 2:
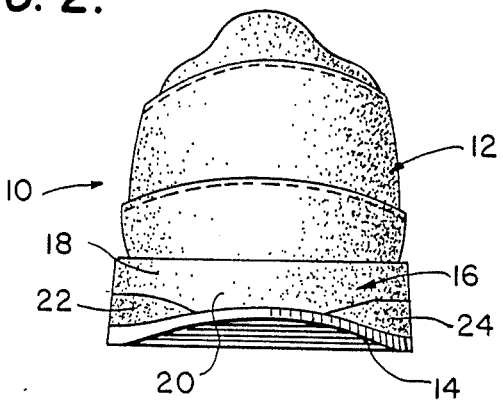
FIG. 2 is an end elevational view thereof.

The footwear 10 which may comprise an athletic shoe typically is of the type used by runners, joggers and the like, and structurally is generally characterized by an upper 12 and a sole unit received on the upper. The upper may be of any style, such as the low-cut variety of upper illustrated in FIGS. 1 and 2.

The sole unit includes an outsole 14 and a midsole/-wedge component 16 (hereafter "component") received between the outsole and upper, and secured to both the outsole and u upper. The manner of securing the parts of the footwear including the upper 12, outsole 14 and component 16 to form the completed athletic shoe may be considered conventional.

The component 16 includes a midsole 18 and a wedge 20. In a fabrication process of manufacture, to be described, the midsole and wedge may be separate parts secured together by an adhesive. As illustrated in FIGS. 1–14, the wedge 20 is located adjacent the outsole 14, extending throughout the region of the heel and forwardly toward the region of the forefoot of the sole unit.

An important feature of the invention is in the provision in the component of a pair of posts, one of which extends along the medial side and the other along the lateral side from the rear of the heel forwardly toward the forefoot. The posts are spaced apart at the rear of the heel and extend forward at least to the region of the heel seat of the wedge. The heel seat of the wedge may be characterized as the part of the component wherein the upper surface is relatively flat. The posts, as desired, may also extend beyond the region of the heel seat of the wedge to the region of the forefoot. The posts may be constructed to be either symmetrical or asymmetrical along the longitudinal axis of the component. By "asymmetical" it should be considered that the posts along the medial and lateral sides of the component have the same height and extend throughout the same length (from the rear of the heel). By "asymmetrical" it should be considered that the posts along the medial and lateral sides of the component are of different heights and/or extend throughout different lengths (from the rear of the heel) Thus, according to the definitions, posts along both the medial and lateral sides of the component, if symmetrical, could be located within the wedge, within both the wedge and midsole to comprise a full post, or within the midsole and extend throughout the same lengths (from the rear of the heel). Posts along the medial and lateral sides of the component, if asymmetrical, could have different heights, or cold extend throughout different lengths (from the rear of the heel), or both. However, the medial post of an asymmetrical arrangement of posts will almost always have the greater height and/or extend throughout the greater length The medial post, further, may have a hardness (Shore A) which is equal to or greater than that of the lateral post.

Figure 3:
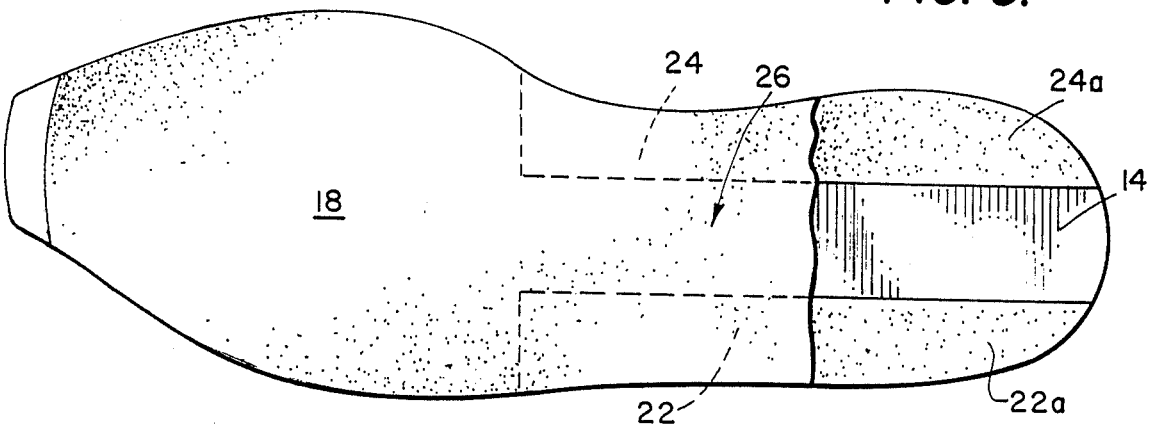
FIG. 3 is a sectional view as seen along the line 3—3 of FIG. 1, with a portion of the midsole/wedge component broken away to more particularly illustrate one form of the invention.

Referring again to FIGS. 1 and 2, and to FIG. 3, there is a showing of the posts of the sole unit including a lateral post 22 and a medial post 24. The posts in these Figures have a symmetrical construction Symmetry of construction follows the formation of posts having a height within the wedge 20 and an extension from the rear of the heel to a point of termination at the region of the forefoot If the medial post had been illustrated as a full post, that is, a post having a height within both the wedge 20 and midsole 18, while the lateral post remained as shown, and/or an extension from the rear of the heel beyond that of the lateral post then the posts would have an asymmetrical construction.

Figure 4:
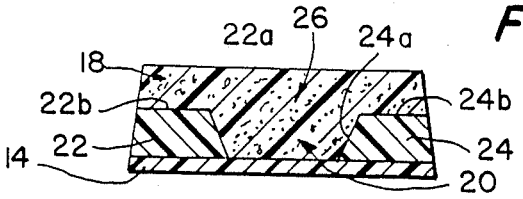
FIG. 4 is a sectional view as seen along the line 4—4 of FIG. 1.

Referring to FIG. 4, there is an illustration of the inner shape of the posts as angled along surfaces **22*a* and 24*a* between a bottom surface of the component at the inner surface of outsole 14 and the flat surfaces 22*b* and 24*b* along the line of demarcation between the wedge 20 and midsole 18. The posts define a channel 26** which extends along the longitudinal axis of the sole unit from the rear of the heel. The channel extends throughout the length of the component.

Figure 5:
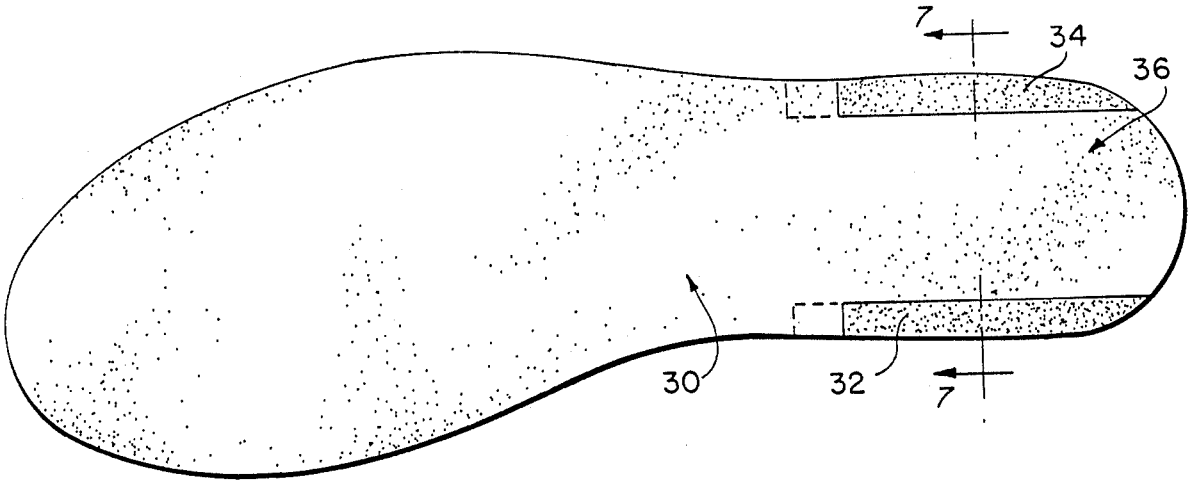
FIG. 5 is a plan view of a midsole/wedge component, illustrating another form of the invention.
Figure 6:
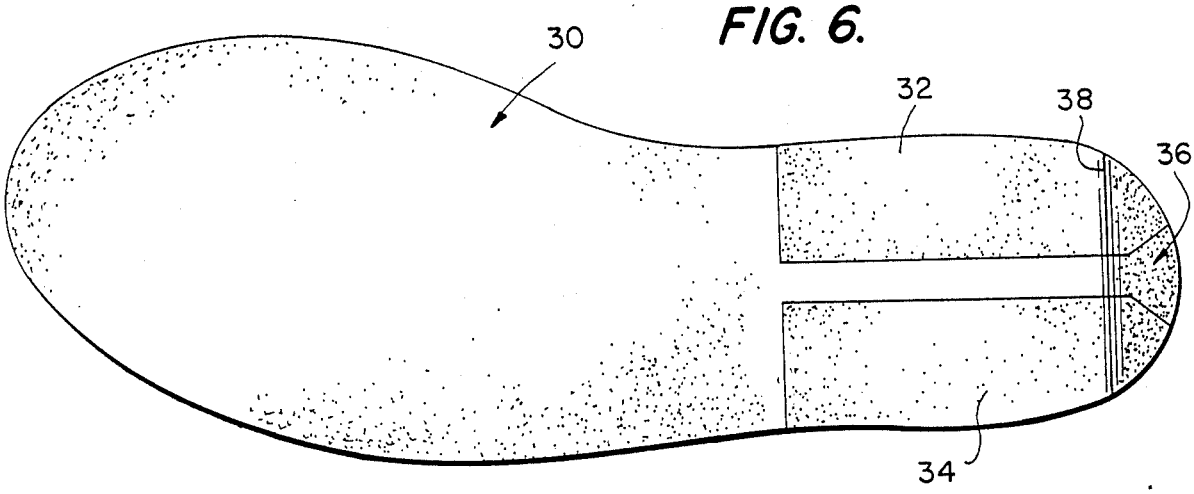
FIG. 6 is a bottom view of the component of FIG. 5.
Figure 7:
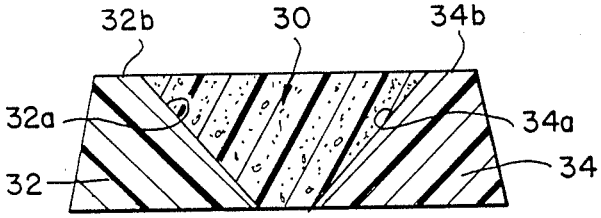
FIG. 7 is a sectional view as seen along the line 7—7 in FIG. 5.
Figure 8:
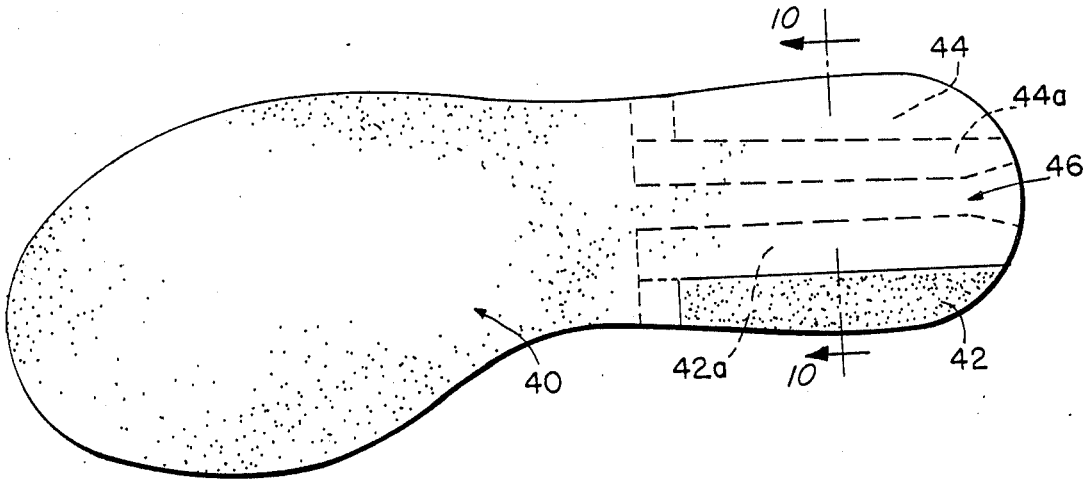
FIG. 8 is a plan view of a midsole/wedge component, illustrating yet another form of the invention.

FIGS. 5–7 illustrate a midsole/wedge component 30 (hereafter "component") which likewise may be received between the outsole 14 and upper 12 of an athletic shoe. The Figures illustrate a pair of posts including a post 32 which extends along the medial side and a post 34 which extends along the lateral side of the component. The posts are symmetrical in that they have the same height and extend throughout the same length (from the rear of the heel). In these Figures the posts have a height within both the wedge and midsole, that is, a full post and extend to the region of the heel seat of the wedge. The posts, also, are angled along surfaces **32*a* and 34*a* between a bottom surface of the component at the inner surface of outsole 14 (not shown in FIGS. 5–7) and the flat surfaces 32*b* and 34*b* comprising a portion of the upper surface of the component. The posts define a channel 36, like the channel of FIG. 4**.

Figure 10:
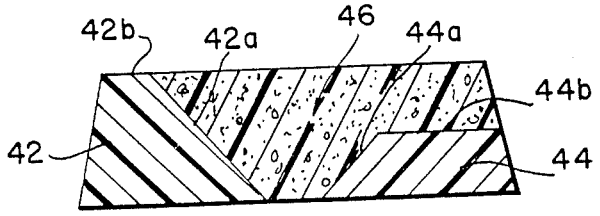
FIG. 10 is a sectional view as seen along the line 10—10 in FIG. 8.
Figure 11:
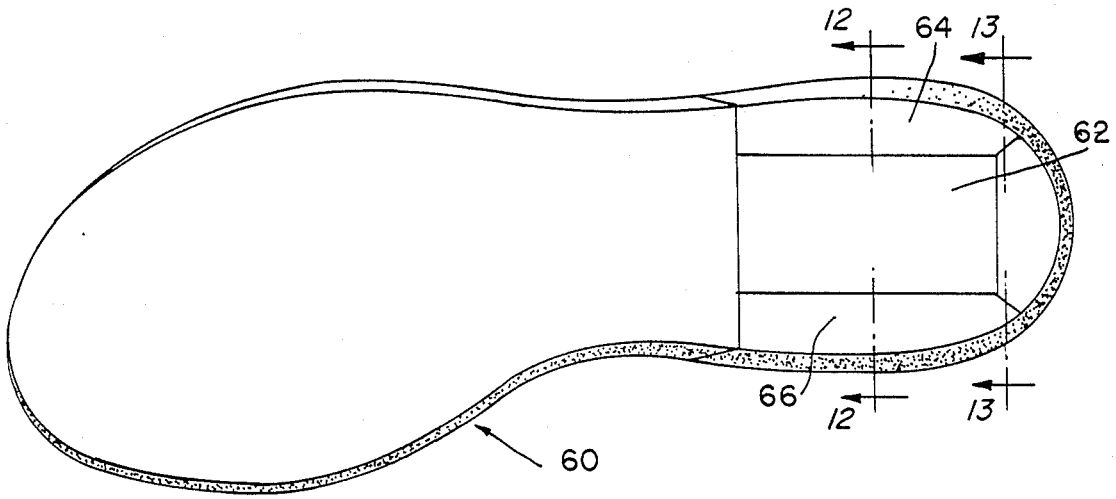
FIG. 11 is a plan view of a midsole/wedge component, illustrating another form of the invention.
Figure 12:
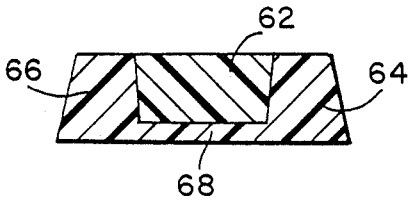
FIGS. 12 and 13 are a sectional views as seen along the line 12—12 and 13—13, respectively, in FIG. 11.
Figure 13:
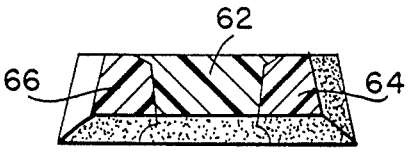
Figure 14:
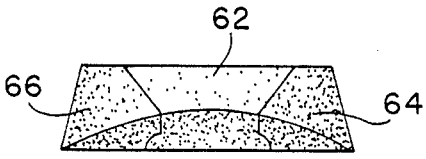
FIG. 14 is a perspective view of a dummy plug used in carrying out a process of the invention.

FIGS. 814 10 illustrate a midsole/wedge component 40 (hereafter "component38 ) which likewise may be received between the outsole 14 and upper 12 of an athletic shoe. The Figures illustrate a pair of posts including a post 42 which extends along the medial side and a post 44 which extends along the lateral side of the component. The posts are asymmetrical in that the medial post is a full post, and the lateral post has a height limited to that of the wedge. The lack of symmetry of posts exists even though posts 42, 44 extend throughout the same length from the rear of the heel. The posts 42, 44 are also angled along surfaces **42*a* and 44*a* between the bottom surface of the component at the surface of the outsole 14 (not shown), and the surfaces 42*b* and 44*b*. The surface 42*b* is located at the top of the component, and the surface 44*b* is located at the line of demarcation between the midsole and wedge. The posts define a channel 46**, like the channels of the forms of the invention already discussed.

Figure 9:
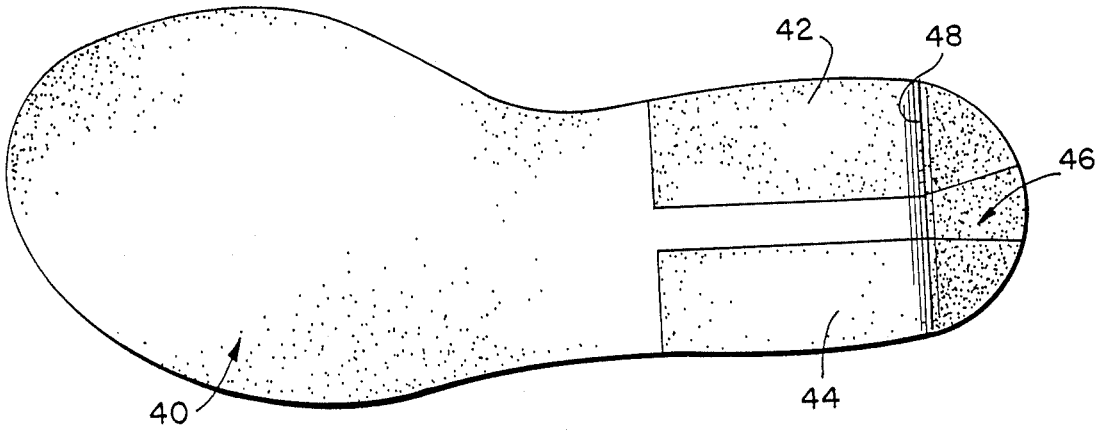
FIG. 9 is a bottom view of the component of FIG. 8.

The lines 38 and 48 of FIGS. 6 and 9 illustrate a bottom contour of the components 30 and 40, respectively.

Each component (16, 30 and 40) is formed of plastic material, such as ethylene-vinyl acetate polymer (EVA) or polyurethane (PU). In the fabrication of the components, the material of the wedge, midsole and posts may be the same, or the material of the posts may be different from that of the midsole and wedge. Whatever the combination, the material of the posts will have a hardness (Shore A) greater than the hardness (Shore A) of the material of the midsole and wedge forming the channel For example, the material forming the channels (26, 36 and 46) may have a hardness (Shore A) within a range between 20 and 40+3 and the material forming each post (22, 24, 32, 34, 42 and 44) may have a hardness (Shore A) within a range between 25 and 45+3. The posts may vary in hardness relative to one another but in all instances a post will have a hardness greater than that of the channel of the component. Thus, the softer channel or core will provide a cushioning effect and the posts will, provide firmness, rear foot stability and control, as well as a capability of self-centering of the foot.

In a representative embodiment, the component may be formed of EVA having posts of symmetrical form. Particularly, the channel may be EVA having a hardness (Shore A) of 25±5, and the posts may be EVA having a hardness (Shore A) of 35+5. As previously indicated, the posts include surfaces adjacent the channel that are angled and upper surfaces, either along the upper surface of the component or the line of demarcation between the wedge and midsole, that are flat. The upper surfaces, for example, the surfaces **32*b*, 34*b* of posts 32, 34 (FIGS. 5–7) may each be about 10 to 15+3 mm in width, and overall the posts may comprise about 25 to 38% of the surface width at the heel at a point of maximum width. The angle of the posts along the channel may be approximately 35° and the outer angle of the posts, along the side of the component, may be approximately 12°. The width of the surface, for example, the surfaces 22*b*, 24*b* (FIGS. 1–4) and 44*b* (FIGS. 8–10**) may be determined under circumstances that the component has an overall thickness of about 24 mm, the wedge has a thickness of about 12 mm and the criteria of width of a full post and angle of channel as set out.

The foot seats itself over the center of gravity, or in the neutral plane along the sole unit, within what may be likened to a cupped area between the posts extending along the lateral and medial sides, onto the softer core of the channel. The angled surfaces of the posts, and their firmer or harder durometer, help to maintain the foot in the neutral plane by a "self-centering" action The greater hardness also helps to control the rear of the foot by minimizing excessive rear foot motion and instability, and the posts aid in the reduction of compression set and fatique of the channel. The increased resistance to breakdown has been found to potentially decrease the incidents of stress-related injury, such as hyperpronation and hypersupenation.

It has been found that a higher degree of motion control stability and compression set may be obtained by the provision that the posts extend within both the wedge and midsole of the component, that is, that the posts are full posts. The full posts provide the aforementioned functions because of the greater mass of EVA around the foot. The increased hardness also lowers the element of fatique, and the incidence of stress-related injury.

If the posts, of a height considered to be full posts, are extended beyond the heel seat area to the forefoot region, the runner will experience yet a higher degree of medial and lateral stability and further enhanced motion control characteristics.

The invention also envisions the use of posts that are asymmetrical in construction. As stated, in an asymmetrical construction one post will have a height greater than the height of the other post and/or one post will extend along a length from the rear of the heel throughout a distance greater than that of the other post. Under normal circumstances, in an asymmetrical construction, the medial post will have the greater height and/or extension. This aspect of the invention serves to create a high degree of motion control, stability and reduced compression set for an individual that tends to pronate or hyperpronate. Since the lateral post is in wedge form it will provide the runner with greater cushioning from the channel and, at the same time, minimize instability upon heel strike.

As a further aspect of the invention, the posts may have a different hardness (Shore A), such as a hardness of 35±5 for the medial post and a hardness of 30+3 for the lateral post. Even though the hardness of the posts may differ, the hardness of the posts will be greater than the hardness of the channel.

The invention envisions several processes for forming the components heretofore described. One process, a fabrication process, has been mentioned in general terms. More specifically, however, according to this process the parts of the component including the wedge, midsole and posts are die cut from stock, such as bun stock material, routed so that each part has the proper angle and bonded or adhesively secured together. Suitable adhesives capable of use with both EVA and PU are known and capable of use. The component that may be fabricated may be of either symmetrical or asymmetrical construction. The particular durometer (Shore A) of hardness of the parts will fall within the ranges described.

The invention also envisions the process whereby the fabricated component may be compression molded. While a fabricated component may have a compression set within the range of about 12 to 15%, the further step of compression molding carried out on the fabricated component may result in compression set within a range of about 3 to 5%. The advantages of a reduction in fatique following this step may be readily appreciated.

The compression molding step will follow the steps of fabricating the component, as above, and, very likely, a step of trimming the component to size to fit into a mold. The fabricated component may be about 105% of the final product formed by compression molding. The compression molding step is completed with heat and pressure to reduce the size of the original cell structure of the fabricated component by minimizing the amount of air and/or gas within the individual cells. The compression (almost like preshrinking or sanforizing) molding process maintains the life of the material of the parts, such as EVA over a period of time longer than non-compressed EVA sheet stock.

Figure 15:
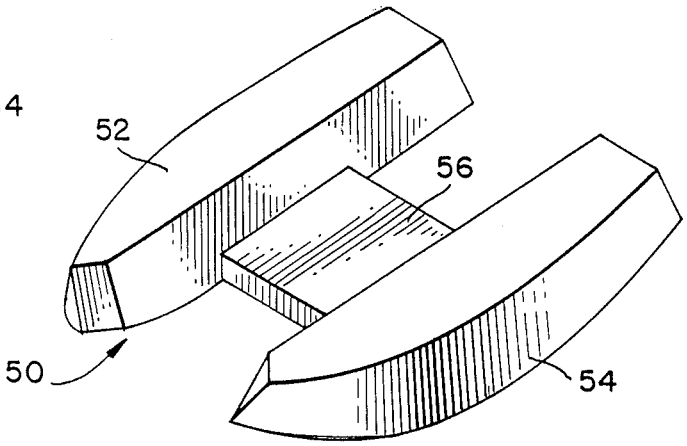

A further process of the invention envisions the formation of molding a midsole/wedge component. According to this process, a channel or core of EVA bun stock material and a member, which may be a dummy plug 50 (see FIG. 15), including a pair of elements 52, 54 and a web 56 joining the elements are supported in a cavity of a mold (not shown) The elements are generally of the outline of the posts heretofore described. The dummy plug may be formed of metal. According to the process of the invention, the channel or core will extend throughout the full component, that is, throughout the heel region and forwardly toward the region of the toes. PU or a similar material is injected into the cavity to encapsulate the channel or core along its exposed outer surfaces and the surfaces adjacent to the dummy plug. The molded part is partially cured and the dummy plug is withdrawn. As apparent, the area theretofore filled by the dummy plug will comprise the area of the posts to be formed by a second injection of PU. The unit is again cured.

The molded midsole/wedge component 60 (hereafter "component") may be seen in FIGS. 11–14. Referring to the Figures, the component includes a channel or core 62 and a pair of posts including a lateral post 64 and medial post 66. The core extends throughout the component and is coated with a skin (not shown) of PU may reach several millimeters in thickness. The skin, for example, may be about 2 to 3 mm in thickness throughout substantially the top and bottom of the component. The skin between the channel and each post 64, 66, an open area located between the dummy plug and core, may reach several millimeters as well. For example, the skin in this region may be about 2 to 5 mm. A skin of about 2 to 5 mm will also be located around the sides of the component. While not shown in FIG. 11, although according to an aspect of the invention, the skin within the top of the component may taper toward an area within the region of the ball of the foot at which the EVA core is exposed.

The outer surface of the component 60 may taper within at least the region of the heel between the bottom and top surfaces at an angle like that of components 18, 30 and 40. As may be seen in FIG. 12, the surface between the channel and posts is substantially vertical and the posts, more particularly the material forming the posts, communicate in a wall 68 below the channel. This particular formation of posts is dictated by the outline of the dummy plug, and particularly the outline of the elements 52, 54 and the web 56. The substantially vertical walls are necessary to permit the dummy plug to be removed from the molded unit following a partial curing.

Component 60 may be formed to provide symmetrical and asymmetrical posts. The particular hardness (Shore A) of the parts will be as previously discussed.

We claim:

1. The process of molding a component of a sole unit for an athletic shoe comprising the steps of supporting a core of a first plastic material having a first hardness (Shore A) in a cavity of a mold, said core defining an integral part of said component and being of a size to extend within a heel region toward the forefoot region of the same, supporting at least one rigid plug member within said cavity juxtaposed and in partially surrounding relation to said core, said at least one plug member serving the function of a dummy plug to prevent a build up of an injected plastic material within regions then occupied by said at least one plug member, injecting a second plastic material into said cavity to fill said cavity to form a shell around said core, at least partially curing said injected plastic injecting a third plastic material which upon curing forms a second resilient plastic material having a second hardness (Shore A) greater than that of the material of said core into said cavity to fill the area heretofore occupied by said plug that said third plastic material forms a set of posts including a lateral post on one side of said core and a medial post on the other said of said core with both posts extending along said core from the heel region, and such that the inner surface of at least one of said posts partially describes the interior outline of said core, and such that the upper surface of at least one of said posts corresponds to an upper surface of said component.

2. The process of claim 1 wherein said first plastic material has hardness (Shore A) less than the hardness (Shore A) of said second and third plastic material.

3. The process of claim 2 wherein said third plastic material has a hardness (Shore A) greater than said second plastic material.

4. The process of claim 1 wherein the first plastic material is ethylene vinyl acetate polymer, and said second and third plastic materials, each of which have a hardness greater than that of said first plastic material, are polyurethane.

5. The process of claim 4 wherein said third plastic material has a hardness greater than said second plastic material.

* * * * *